US010273067B2

(12) United States Patent
Mark et al.

(10) Patent No.: US 10,273,067 B2
(45) **Date of Patent: *Apr. 30, 2019**

(54) PACKAGE FOR STORING A PLURALITY OF PRODUCTS

(71) Applicant: The Gillette Company LLC, Boston, MA (US)

(72) Inventors: Erwin Paul Mark, Eschborn (DE); Craig Wilburn, West Chester, OH (US); Martin Jay Marotti, Carmel, IN (US); Oliver Horst Heilmann, Bad Soden (DE); Harald De Buhr, Frankfurt (DE); Eric Latza, Schwalbach (DE); Christian Stief, Frankfurt (DE)

(73) Assignee: THE GILLETTE COMPANY LLC, Boston, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/223,905

(22) Filed: Jul. 29, 2016

(65) Prior Publication Data

US 2017/0190490 A1 Jul. 6, 2017

(30) Foreign Application Priority Data

Jul. 29, 2015 (EP) ..... 15178784

(51) Int. Cl.
*B65D 75/36* (2006.01)
*B65D 65/38* (2006.01)
(Continued)

(52) U.S. Cl.
CPC ..... *B65D 75/367* (2013.01); *B65D 65/38* (2013.01); *B65D 73/0021* (2013.01); *B65D 75/527* (2013.01)

(58) Field of Classification Search
CPC ..... A46B 15/00; A46B 15/0093; B65B 47/02; B65B 47/0225; B65D 71/46; B65D 71/50;
(Continued)

(56) References Cited

U.S. PATENT DOCUMENTS 2,993,590 A 7/1961 Denton
3,220,543 A 11/1965 McCord et al.
(Continued)

FOREIGN PATENT DOCUMENTS

CN 202987849 6/2013
DE 7920462 10/1979
(Continued)

OTHER PUBLICATIONS

International Search Report with Written Opinion, dated Sep. 5, 2016, 10 pages.
Jul. 29, 2016 U.S Appl. No. 15/223,808 Erwin Paul Mark et al.

*Primary Examiner* — Bryon Gehman

(57) ABSTRACT

A package kit for storing a plurality of products includes a primary package and a secondary package. The primary package has a plurality of individually sealed and separately detachable cavities. The secondary package is sandwiched between a back panel and a front panel of the secondary package. The front panel includes a first aperture and a second aperture for displaying at least a portion of the primary package. A first outer circumferential portion at least partially surrounds the first aperture, and a second outer circumferential portion at least partially surrounds the second aperture. The front panel includes an elevated portion disposed between the apertures and extending from the first and second outer circumferential portions.

15 Claims, 5 Drawing Sheets

(51) Int. Cl.
*B65D 73/00* (2006.01)
*B65D 75/52* (2006.01)

(58) Field of Classification Search
CPC B65D 73/00; B65D 73/0021; B65D 73/0092; B65D 75/36; B65D 75/366; B65D 75/367; B65D 75/52; B65D 75/527; B65D 77/26; B65D 85/20–85/28; B65D 65/38
USPC ..... 206/362.1–362.3, 369, 372, 380–382, 206/485, 526
See application file for complete search history.

(56) References Cited

U.S. PATENT DOCUMENTS 3,948,391 A * 4/1976 Beaman ..... B65D 75/366 206/382
5,414,890 A 5/1995 Morando
5,428,940 A * 7/1995 Paumen ..... B65D 71/16 206/705
5,544,755 A 8/1996 Paumen et al.
5,586,657 A 12/1996 Ward
5,871,100 A 2/1999 Ward
D423,344 S 4/2000 Kumakura et al.
D423,928 S 5/2000 Kumakura et al.
6,397,860 B1 6/2002 Hill, II
D479,125 S 9/2003 Kumakura et al.
D479,126 S 9/2003 Kumakura et al.
6,726,011 B2 4/2004 Sarkar et al.
D548,617 S 8/2007 Ferguson et al.
D548,618 S 8/2007 Ferguson et al.
D548,619 S 8/2007 Ferguson et al.
D548,620 S 8/2007 Ferguson et al.
D548,886 S 8/2007 Lee
D549,111 S 8/2007 Ferguson et al.
D556,601 S 12/2007 Ferguson et al.
7,325,686 B2 * 2/2008 Aldridge ..... B65D 71/0085 206/460
7,424,952 B2 9/2008 Antler
D580,749 S 11/2008 Miller
7,866,477 B2 1/2011 Sturm et al.
8,033,287 B2 10/2011 Cullup
8,066,178 B2 11/2011 Sorrentino et al.
8,393,469 B2 * 3/2013 Aldridge ..... B65D 5/5425 206/460
8,511,467 B2 8/2013 Sorrentino et al.
8,528,806 B2 9/2013 Sorrentino et al.
9,033,150 B2 * 5/2015 Andrich ..... B65D 25/54 206/378
2003/0024848 A1 2/2003 Oycke
2007/0187264 A1 8/2007 Hofte et al.
2010/0300926 A1 * 12/2010 Specker ..... B65D 5/504 206/564
2012/0205276 A1 8/2012 Shackford
2013/0313155 A1 11/2013 Ha et al.

FOREIGN PATENT DOCUMENTS

DE 9102473 5/1991
FR 2276801 1/1976
JP 2001253475 A * 9/2001
JP 2004081656 3/2004
JP 200300350 7/2004
JP 2008150062 7/2008
JP 2013220834 10/2013
KR 200390038 11/2003
WO WO9517116 6/1995
WO WO9722528 6/1997
WO WO2004043203 5/2004
WO WO 2006079192 8/2006

* cited by examiner

PACKAGE FOR STORING A PLURALITY OF PRODUCTS

FIELD OF THE INVENTION

The present disclosure is concerned with a package kit comprising a primary package for storing a plurality of products, and a secondary package. The present disclosure is further concerned with a package-product arrangement comprising such package kit and a plurality of products, and a process for the manufacture of such package-product arrangement.

BACKGROUND OF THE INVENTION

Packages for storing and providing a plurality of products for sale, like disposable consumer products, are well known in the art. In the following, such packages are referred to as "multipacks".

Consumer products, for example personal hygiene products, like oral care implements, are commonly packaged for sale in blister multipacks. These multipacks typically comprise a blister layer having a plurality of blister cavities in which the products are stored. The blister layer is usually attached to a cardboard blank. If a consumer wants to take one of the products out of the multipack, he will remove the blister layer from the cardboard blank to some extent, thereby partially destroying the package. Consequently, the products remaining in the multipack are not completely sealed by the blister layer anymore. Since the products are not properly sealed in a hygienic manner after opening the multipack, there is a risk for contamination. In addition, the partial destruction of the package renders the overall appearance of the package less attractive. Furthermore, such blister multipacks do not provide sufficient space for printing information and/or artwork on the front side of the package.

Further, another type of multipack is known in the art for packing batteries and other elongated consumer products. Such multipack is made of a single material, preferably being biodegradable, e.g. cardboard material, in which elongated articles can be held reliably in a desired orientation, for example with a trademark facing forwards. A sheet of cardboard is folded about parallel lines to form a channel with a pair of aligned openings in opposite integral limbs of the channel to receive and fit closely about the side of end regions of the packed article inserted in the openings. End locating regions are provided for retaining the article in the openings. The limbs are taut, thereby frictionally gripping and preventing rotation of the article.

While this type of package provides an environmentally desirable solution for storing and selling a plurality of articles, it is not as well suited to provide a hygienic storing solution of the remaining articles once the package has been opened. Here again, the appearance of the package is less attractive once the package is opened and one article is removed.

It is an object of the present disclosure to provide a package for storing a plurality of products, which is easy to handle, in particular easy to open, and which package hygienically protects remaining products once the package has been opened to remove one of the products from the package. Further, products remaining in the package shall be provided in an appealing/attractive way. Additionally, the package should provide sufficient space for printing/displaying information and/or artwork.

SUMMARY OF THE INVENTION

In accordance with one aspect, a package kit for storing a plurality of products is provided, the package kit comprising:

a primary package, and a secondary package, the primary package comprising a plurality of individually sealed cavities for individually storing a product, the individually sealed cavities being separately detachable from the primary package, the secondary package comprising a back panel and a front panel, the primary package being sandwiched between the back panel and the front panel, the front panel comprising at least a first aperture and a second aperture for displaying at least a portion of the primary package, at least a first outer circumferential portion at least partially surrounding the first aperture and being attached at least partially to the back panel, and a second outer circumferential portion at least partially surrounding the second aperture and being attached at least partially to the back panel, wherein the front panel further comprises an elevated portion being arranged between the first and the second aperture, and extending from the first and the second outer circumferential portion.

In accordance with one aspect, a package-product arrangement is provided that comprises such package kit and a plurality of products.

In accordance with one aspect, a process for manufacturing a package-product arrangement is provided. The process comprises the following steps:

providing a plastic sheet, inserting the plastic sheet into a mold having a plurality of mold cavities, heating the plastic sheet to a forming temperature in order to be pliable, thermoforming a plurality of cavities into the plastic sheet, the cavities corresponding to the shape of the mold cavities, thereby providing a blister layer comprising a plurality of blister cavities, providing a plurality of products, inserting the products into respective blister cavities, providing a cardboard blank, attaching the cardboard blank onto the blister layer, thereby providing a primary package comprising a plurality of products, providing a front panel in a substantially flat manner, the front panel comprising at least a first aperture and a second aperture, at least a first outer circumferential portion at least partially surrounding the first aperture, and a second outer circumferential portion at least partially surrounding the second aperture, and a portion being arranged between the first and the second aperture and extending from the first and the second outer circumferential portions, folding the front panel in a manner that the portion being arranged between the first aperture and the second aperture is elevated with respect to the first and second outer circumferential portions and forms an inner recess, laying the primary package onto the front panel so that the blister cavities are placed in the recess, and extend at least partially through the first aperture and the second aperture, providing a back panel, and attaching the back panel to at least a portion of the first outer circumferential portion and to at least a portion of the second outer circumferential portion, thereby providing a secondary package comprising the primary package and the products.

In accordance with one aspect, a package-product arrangement obtainable or obtained by said process is provided.

BRIEF DESCRIPTION OF THE DRAWINGS

The invention is described in more detail below with reference to various embodiments and figures, wherein.

DETAILED DESCRIPTION OF THE INVENTION

Figure 1:
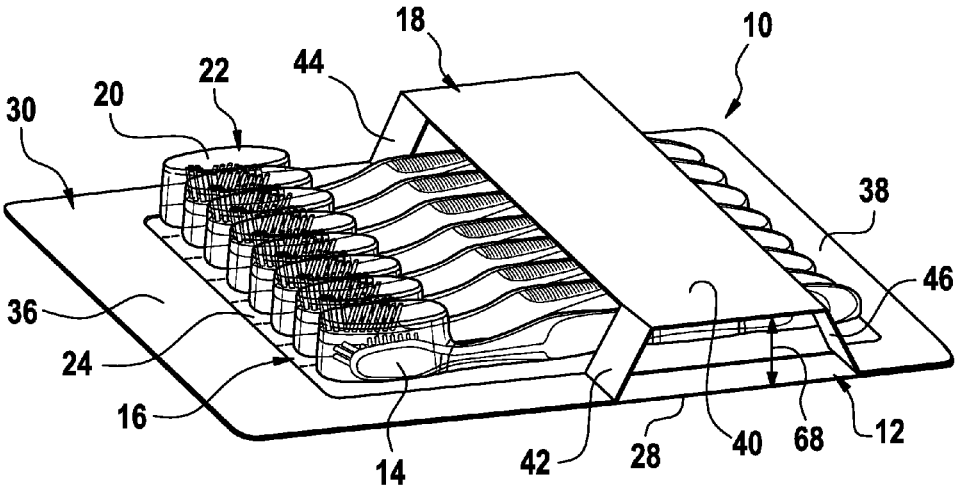
FIG. 1 shows a schematic perspective view of a first example embodiment of a product-package arrangement comprising a primary and a secondary package.

A package kit in accordance with the present disclosure comprises an inner primary package and an outer secondary package, i.e. the primary package is stored/provided in the outer secondary package. The primary package comprises a plurality of individually sealed cavities for individually storing a plurality of products. For example, the products may be disposable consumer products, e.g. oral care implements, in particular toothbrushes. One or more of the individually sealed cavities can be detached/removed from the primary package without destroying the sealing of the remaining cavities. Therefore, the products in the respective cavities may remain hygienically stored and protected against contamination once one or more cavities are detached form the primary package. Additionally, the remainder of the primary package remains aesthetically appealing since the primary package remains undamaged.

The primary package is packed in the secondary package. The secondary package comprises a back panel and a front panel between which the primary package is sandwiched and stored. The front panel comprises at least a first and a second aperture for displaying at least a portion of the primary package. The at least first and/or second aperture may be a cut-out window which may be covered, for example, by a transparent foil, or, alternatively it may be uncovered.

The front panel further comprises at least a first outer circumferential portion which at least partially surrounds the first aperture, and a second outer circumferential portion which at least partially surrounds the second aperture. Both, the first and the second circumferential portions are at least partially attached to the back panel to keep the secondary package in a closed position. For example, the back panel may be attached/connected to the front panel by means of hot or cold sealing, adhesive tape application, adhesive and/or glue. The outer circumferential portion of the primary package may be placed between a portion of the first and the second outer circumferential portion of the front panel and the pack panel, respectively, to retain the primary package between the front and the back panel of the secondary package.

Both, the primary package and the secondary package may be shaped as a square or rectangle—when seen in a top down view—, each having four lateral edges, i.e. an upper and a lower lateral edge along the width extension of the package kit being opposite each other, and two lateral edges along the length extension of the package kit being opposite each other. Further, the first and the second apertures may also be shaped as a square or rectangle to display at least a portion of the products. For example, the first circumferential portion of the front panel may be arranged along the upper lateral edge and along a portion of both lateral edges along the length extension, and the second circumferential portion may be arranged along the lower lateral edge and along a portion of both lateral edges along the length extension.

Moreover, the front panel comprises an elevated portion being arranged between the first and the second aperture. The term "elevated portion" refers to a portion being more elevated than any other portion of the secondary package when the package is seen in a side view. The elevated portion extends from both, the first outer circumferential portion and the second outer circumferential portion and forms a boundary of the first and the second aperture. The elevated portion may extend between the two opposed lateral edges of the secondary package in a substantially perpendicular or angled manner. The elevated portion may provide the package kit with improved stability properties, thereby protecting the products stored therein from getting damaged during shipping, distribution and sale. Furthermore, the elevated portion may provide space for printing/displaying artwork and/or information pertaining to properties of the products stored within the package kit.

A package-product arrangement according to the present disclosure comprises a package kit and a plurality of products. At least one of said products may be an oral care implement, for example a manual toothbrush or a refill for an electrical toothbrush. In some embodiments, the package-product arrangement may comprise a package kit storing eight, seven, six or less individually sealed oral care implements. However, the package-product arrangement may also comprise more than eight individually sealed oral care implements, for example nine or ten or even more individually sealed oral care implements.

In case a consumer wants to remove a product from the package-product arrangement, he may remove the back panel from the front panel thereby opening the secondary package. The secondary package may be discarded. A desired number of products may be detached from the primary package without damaging the remaining individually sealed cavities. Therefore, the remaining products stay hygienically sealed and protected against contamination. Further, the overall appearance of the remainder of the primary package stays aesthetically appealing.

In some embodiments, the back panel of the secondary package may comprise at least one perforation zone, e.g. a perforation line to facilitate opening the secondary package by tearing/cutting along said perforation.

In some embodiments, the first outer circumferential portion may comprise a first limb and a second limb, and the second outer circumferential portion may comprise a third limb and a fourth limb, and the elevated portion may extend from the first, the second, the third and the fourth limb, respectively. The first and the second limb may be extensions of the first outer circumferential portion and may be arranged at the lateral edges along the length extension of the package kit, respectively. The third and the fourth limb may be extensions of the second outer circumferential portion and may be arranged at the lateral edges, respectively. The first, second, third and fourth limbs may extend from the first and second outer circumferential portions in a substantially perpendicular or angled manner in a direction away from the back panel. In other words, between two opposite limbs arranged at one lateral edge, there is a region where the front panel is not attached to the back panel. Instead, the front panel is elevated and forms the elevated portion. Between the upper surface of the back panel and the lower surface of the elevated portion of the front panel, a clearance/cutout is provided which may serve as a gripping aid and which may facilitate handling and gripping the package kit. A consumer may place his/her fingers into the clearance/cutout for easy picking and handling of the package kit.

In some embodiments, the first and the second limbs may be hingeably connected to the first outer circumferential portion, and the third and the fourth limbs may be hingeably connected to the second outer circumferential portion. Further, the elevated portion may be hingeably connected to the first, second, third and fourth limbs. Such hingeable connection may be provided by means of a crease, a perforation or a folding line. In other words, each of the limbs may extend from the respective outer circumferential portions in a hingeable manner, and the elevated portion may extend from the limbs in a hingeable manner. This may allow the elevated portion to move/bend slightly in opposite directions, i.e. some flexibility is given to the elevated portion. In case pressure is applied onto the upper surface of the elevated portion from a direction not perpendicular to said upper surface, the elevated portion may slightly move/bend in the direction of pressure avoiding damage to the elevated portion.

Further, such hingeable connection between the limbs and the outer circumferential portions and the elevated portion and the limbs may allow the front panel to be provided in a substantially flat manner before connecting/attaching the front panel to the back panel in a process for manufacturing a package kit or a package-product arrangement.

In some embodiments, the front panel and/or the back panel may be unitarily formed from a cardboard blank. In case the secondary package is at least partially made of cardboard material being substantially recyclable, an environmentally sustainable package may be provided. The cardboard blank may be a single- or multi-layer cardboard. The cardboard blank may have a weight, i.e. a surface weight of from about 250 g/m$^2$ to about 600 g/m$^2$, optionally of from about 300 g/m$^2$ to about 500 g/m$^2$, further optionally of about 400 g/m$^2$. A package having a cardboard weight of about 400 g/m$^2$ may provide sufficient stability to the package while the cardboard can still be folded easily along hinges, creases or folding lines. Flapping/turning hinged limbs and/or hinged elevated portions into the required positions during manufacturing processes may be performed in a relatively facile manner.

In some embodiments, the front panel and the back panel of the secondary package may be unitarily formed from one cardboard blank, i.e. the secondary package is formed from one piece of cardboard blank which may be a single- or multi-layer cardboard.

Alternatively, in some embodiments, front and back panel may be formed from separate cardboard blanks, and the weight, i.e. the surface weight of the cardboard blank of the front panel may be equal to or different from the weight of the cardboard blank of the back panel, i.e. the weight of the cardboard blank of the front panel may be higher or lower than the weight of the cardboard blank of the back panel. Forming front and back panel from two separate cardboard blanks allows more flexibility with respect to package properties. For example, the back panel may have a lower weight, e.g. of from about 200 g/m$^2$ to about 250 g/m$^2$, to provide a lighter overall package. The front panel may have a higher weight than the back panel, e.g. of from about 300 g/m$^2$ to about 400 g/m$^2$, to provide sufficient stability properties of the package kit. Further, the back panel may be provided with printings in a cost efficient manner, e.g. only in one color or may be provided without any printings to provide a package at lower costs. Instead, artwork and/or information may be printed onto the front panel only, for example in the form of color prints comprising metallic effects.

In some embodiments, the secondary package may comprise a flap hingeably connected to a lateral edge of the first or second outer circumferential portion of the front panel, and/or a flap may be hingeably connected to a lateral edge of the back panel. The flap may provide space for printing artwork and/or information, for example information pertaining to product properties. The hingeable connection may be provided by means of a crease, a perforation or a folding line. The hingeable connection may allow the flap to be turned upwards in an open position or downwards onto, i.e. in alignment with the front panel. In case artwork and/or information is printed onto the inner surface of the flap facing the upper surface of the front panel, information can be hidden from immediate visual inspection at the point of sale, for example, by flapping the flap onto the front panel. Before a product is taken out of the package kit, the consumer may turn the flap in an open/upward position to read the respective information. The flap and the front panel may be unitarily formed from one cardboard blank.

In some embodiments, the primary package may be a blister package. The blister package may have a blister layer being attached onto a cardboard blank and comprising a plurality of transparent blister cavities. Therefore, at least a portion of the plurality of products stored in the cavities may be visible through the at least first and/or second aperture provided in the front panel of the secondary package.

In some embodiments, the back panel of the secondary package may comprise at least one aperture allowing visual inspection of at least a portion of the primary package. Said aperture provided in the back panel may be covered with a transparent foil or transparent plastic layer to protect the primary package. In some embodiments, both, the cardboard blank of the primary blister package and the back panel of the secondary package may comprise overlapping portions through which the products are at least partially visible, for example by means of apertures which may be covered with transparent foils or transparent plastic layers to protect the products stored the package kit. For example, in case the products are oral care implements, like manual toothbrushes or refills for electrical toothbrushes, the heads of such oral care implements may be visible allowing visual inspection of specific features of the products, like tongue cleaners arranged on the backside of the head, i.e. on the side opposing the bristle bearing face. Alternatively, the overall oral care implement may be visible through one or a plurality of apertures which may be covered by transparent foils or transparent plastic layers.

In some embodiments, the primary package may comprise a plurality of perforation lines provided between two neighboring blister cavities and extending through the blister layer and the cardboard blank to facilitate detaching one or more individually sealed cavities from the remaining portion of the primary package. Once one or more cavities with respective products are detached from the primary package, the remaining products remain stored in their respective individually sealed cavities in a hygienically and appealing manner.

In some embodiments, the cardboard blank of the primary blister package may be a single- or multi-layer cardboard blank. The cardboard blank may have a weight, i.e. a surface weight of from about 250 g/m$^2$ to about 600 g/m$^2$, optionally of from about 300 g/m$^2$ to about 500 g/m$^2$, further optionally of about 400 g/m$^2$. A cardboard weight of about 400 g/m$^2$ may provide sufficient stability to the blister package while one or more blister cavities including the respective cardboard portion can still be detached easily, e.g. along a perforation line.

The package kit may have a length extension of from about 200 mm to about 350 mm, optionally of from about 250 mm to about 320 mm, further optionally of about 302 mm, a width extension of from about 200 mm to about 350 mm, optionally of from about 250 mm to about 300 mm, further optionally of about 275 mm, and a height extension of from about 10 mm to about 40 mm, optionally of from about 20 mm to about 30 mm, further optionally of about 27 mm.

A process for manufacturing the primary package comprises the following steps:

providing a plastic sheet, inserting the plastic sheet into a mold having a plurality of mold cavities, heating the plastic sheet to a forming temperature in order to be pliable, thermoforming a plurality of cavities into the plastic sheet, the cavities corresponding to the shape of the mold cavities, thereby providing a blister layer comprising a plurality of blister cavities, providing a plurality of products, inserting the products into the respective blister cavities, providing a cardboard blank, and attaching the cardboard blank onto the blister layer, thereby providing a primary package comprising a plurality of products.

In some embodiments the plastic sheet may be a PET plastic sheet. Further, during the thermoforming step, eight, seven, six or less blister cavities may be formed. However, the blister layer may also be formed with more than eight blister cavities, for example nine or ten or even more blister cavities, and a respective number of products may be inserted into the cavities. Further, the cardboard blank may be attached/connected to the blister layer by means of hot or cold sealing, adhesive tape application, adhesive and/or glue.

In some embodiments, after the cardboard blank is attached onto the blister layer, the process may further comprise the step of die-cutting the outer circumferential rim of the primary package to a desired contour.

The process for manufacturing the secondary package comprising the primary package and the products, thereby forming a package product arrangement, comprises the following steps:

providing a front panel in a substantially flat manner, the front panel comprising at least a first aperture and a second aperture, at least a first outer circumferential portion at least partially surrounding the first aperture, and a second outer circumferential portion at least partially surrounding the second aperture, and a portion being arranged between the first and the second aperture and extending from the first and the second outer circumferential portions, folding the front panel in a manner that the portion being arranged between the first aperture and the second aperture is elevated with respect to the first and second outer circumferential portions and forms an inner recess, laying the primary package onto the front panel so that the blister cavities are placed in the recess, and extend at least partially through the first aperture and the second aperture, providing a back panel, and attaching the back panel to at least a portion of the first outer circumferential portion and to at least a portion of the second outer circumferential portion, thereby providing a secondary package comprising the primary package and the products.

In some embodiments, the back panel may be attached/connected to the front panel by means of hot or cold sealing, adhesive tape application, adhesive and/or glue.

In some embodiments, the front panel may be slightly larger in the width extension and/or in the length extension than the back panel. In other words, the front panel may slightly overlap/project over the back panel in order to adjust/balance variations in positioning the back panel onto the front panel. Further, this may ensure that the back panel is not visible when the package-product arrangement is seen from a top-down view, e.g. when the back panel is less attractive than the front panel. For example, the front panel may have a length extension and/or a width extension being from about 0.3 mm to about 1 mm larger than the respective extensions of the back panel.

The following is a non-limiting discussion of example embodiments of package-product arrangements in accordance with the present disclosure, where reference to the Figures is made.

Figure 2:
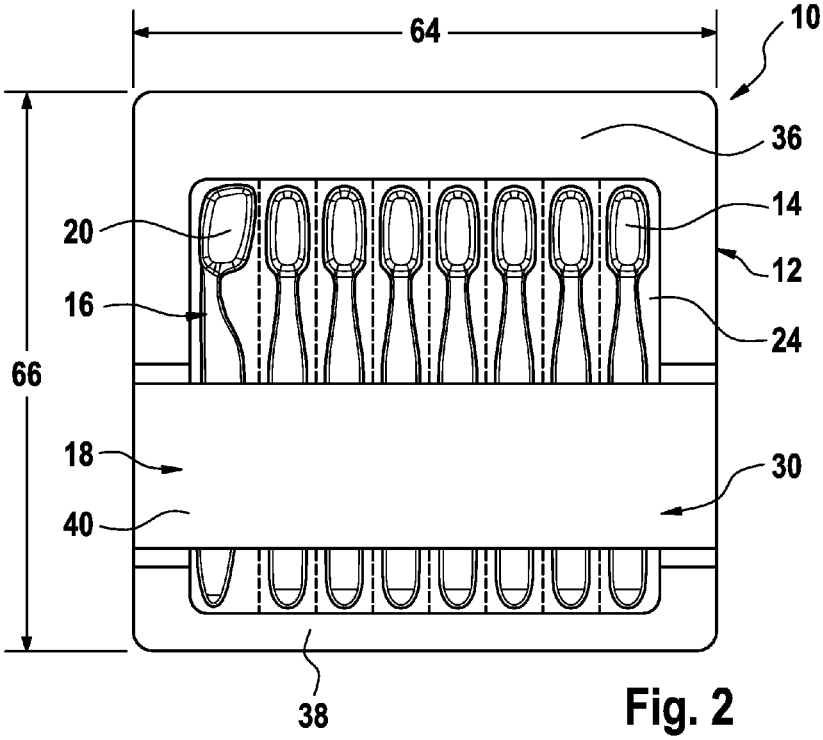
FIG. 2 shows a schematic top-down view of the product-package arrangement of FIG. 1.
Figure 3:
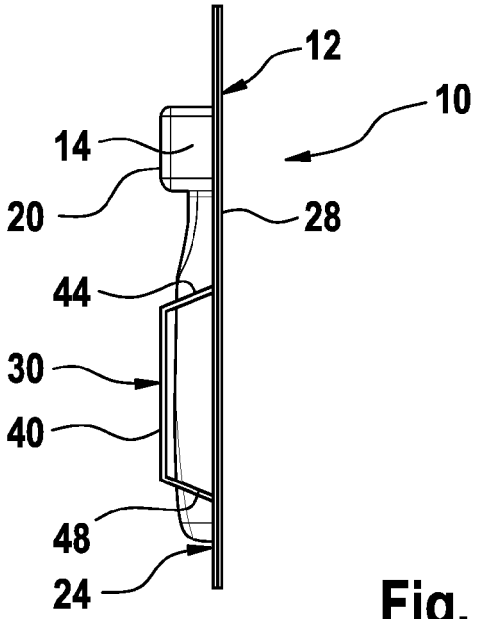
FIG. 3 shows a schematic side view of the product-package arrangement of FIG. 1.

FIGS. 1, 2 and 3 show a perspective view, a top-down view and a side view, respectively, of a package-product arrangement 10 comprising a package kit 12 and a plurality of products 14 stored therein. The products 14 are manual toothbrushes 14, although other products can be stored in the package kit 12, as well, for example other consumer goods, e.g. refills for electrical toothbrushes.

Figure 4:
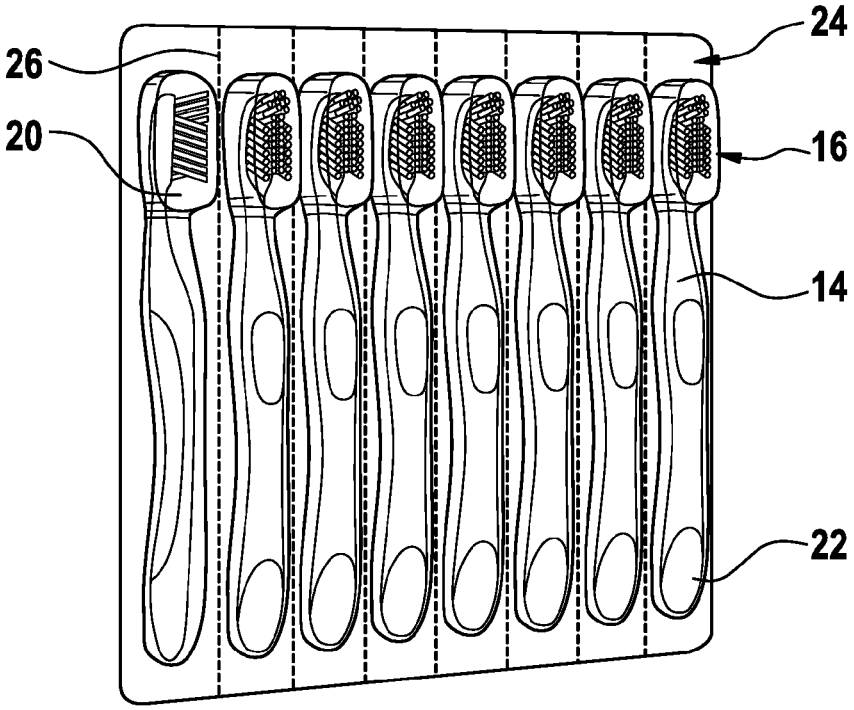
FIG. 4 shows a schematic perspective view of the primary package of the product-package arrangement of FIG. 1.

The package kit 12 comprises a primary package 16 (cf. FIG. 4), and a secondary package 18. As shown in FIG. 4, the primary package 16 is a blister package 16 comprising a blister layer 22 with a plurality of blister cavities 20 for individually receiving a product 14. In order to provide individually sealed cavities 20, a cardboard blank 24 is attached to the backside of the blister layer 22. Between each individually stored toothbrush 14, i.e. between two neighboring cavities 20, a perforation line 26 is provided for detaching one or more products 14 individually form the primary package 16.

The secondary package 18 comprises a back panel 28 and a front panel 30 between which the primary package 16 is sandwiched. The front panel 30 comprises at least a first aperture 32 and a second aperture 34 for displaying at least a portion of the primary package 16. At least a first outer circumferential portion 36 at least partially surrounds the first aperture 32 and is attached at least partially to the back panel 28. At least a second outer circumferential portion 38 at least partially surrounds the second aperture 34 and is attached at least partially to the back panel 28. The front panel 30 further comprises an elevated portion 40 being arranged between the first aperture 32 and the second aperture 34, and extending from the first and the second outer circumferential portions 36, 38. The first outer circumferential portion 36 comprises a first limb 42 and a second limb 44, and the second outer circumferential portion 38 comprises a third limb 46 and a fourth limb 48, and the elevated portion 40 extends from the first, the second, the third and the fourth limbs 42, 44, 46, 48, respectively. The first and the second limbs 42, 44 are hingeably connected to the first outer circumferential portion 36, and the third and the fourth limbs 46, 48 are hingeably connected to the second outer circumferential portion 38. The elevated portion 40 is hingeably connected to the first, the second, the third and the fourth limb 42, 44, 46, 48 to provide the elevated portion 40 with some flexibility.

The front panel 30 and the back panel 28 are formed from two separate cardboard blanks 30, 28. Alternatively, the front panel 30 and the back panel 28 may be unitarily formed from one piece of cardboard blank and the front panel 30 and the back panel 28 may be hingeably connected via a crease, a perforation or a folding line.

Figure 5:
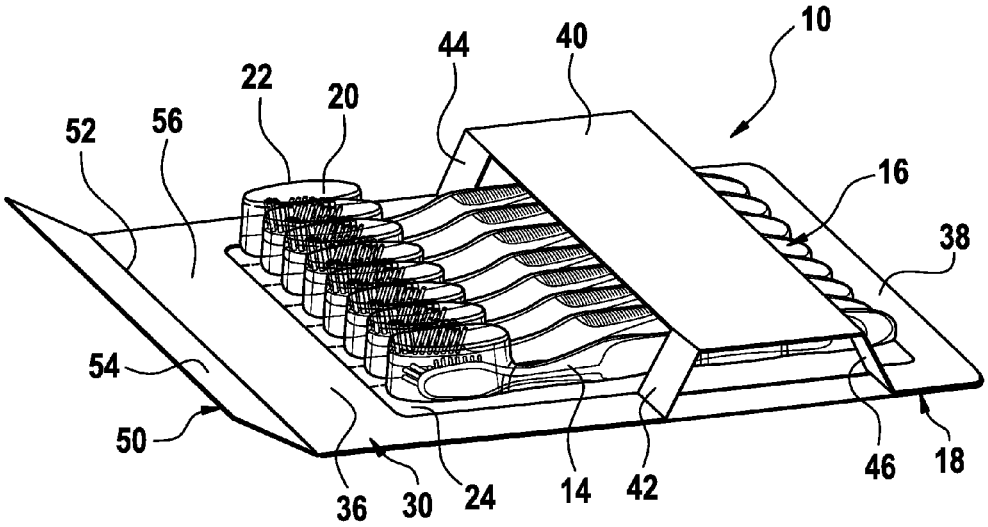
FIG. 5 shows a schematic perspective view of a second example embodiment of a product-package arrangement comprising a flap in an open position.
Figure 6A:
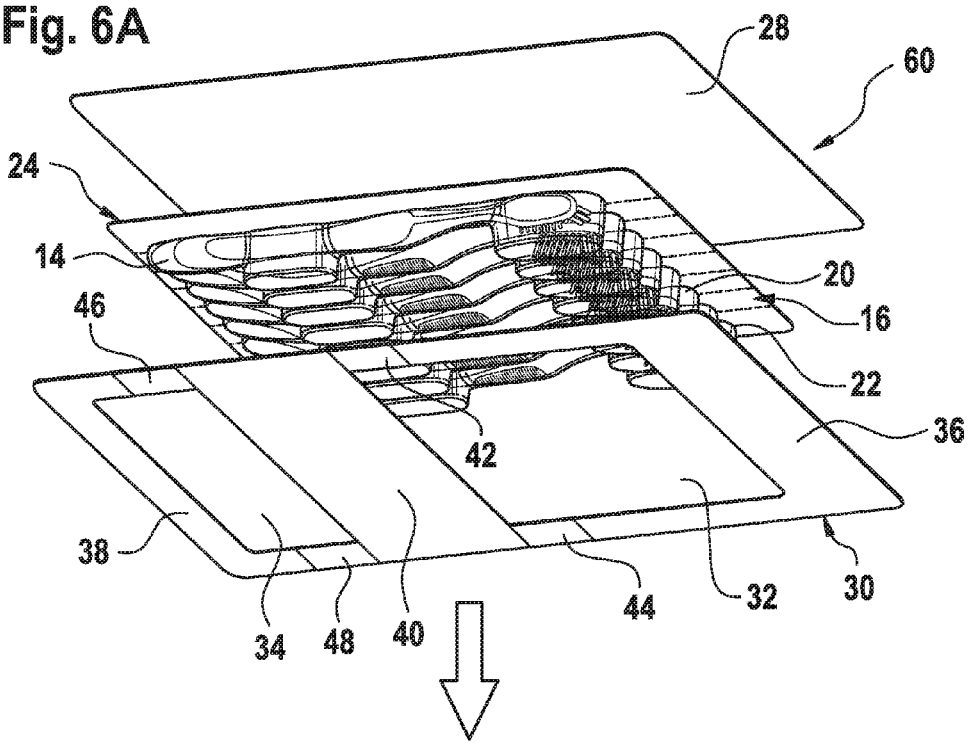
FIGS. 6A-6D show process steps for manufacturing a package-product arrangement as shown in FIG. 1.
Figure 6B:
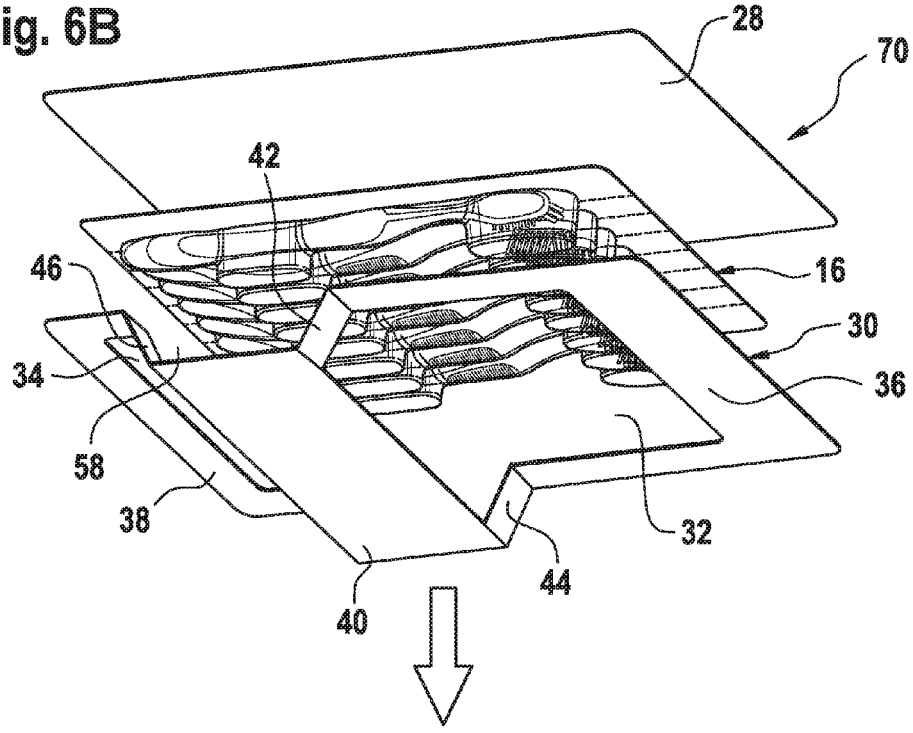
Figure 6C:
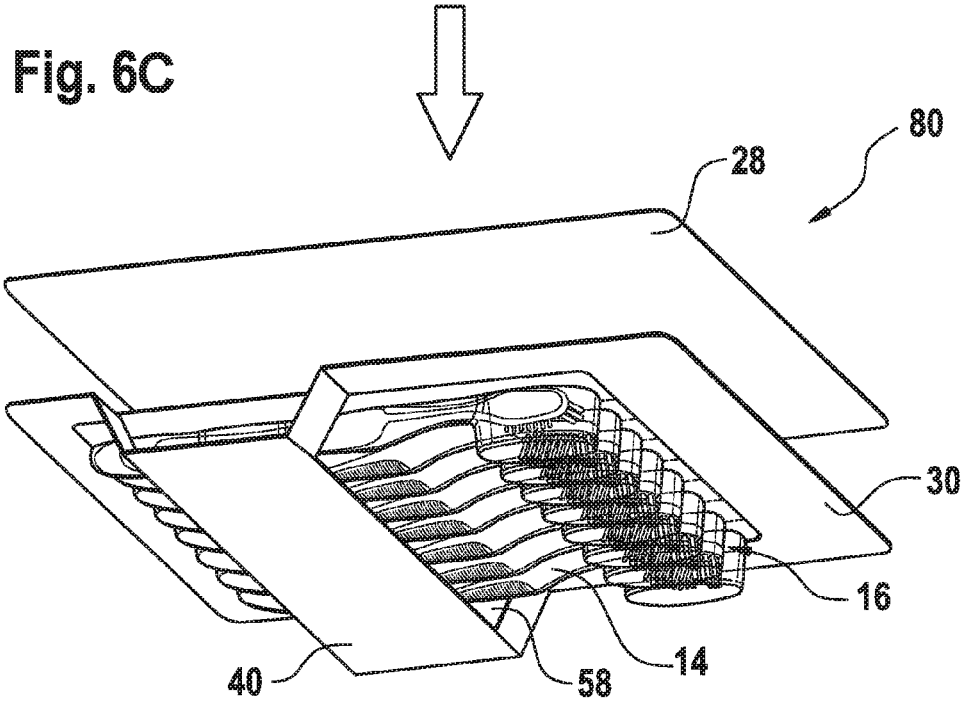
Figure 6D:
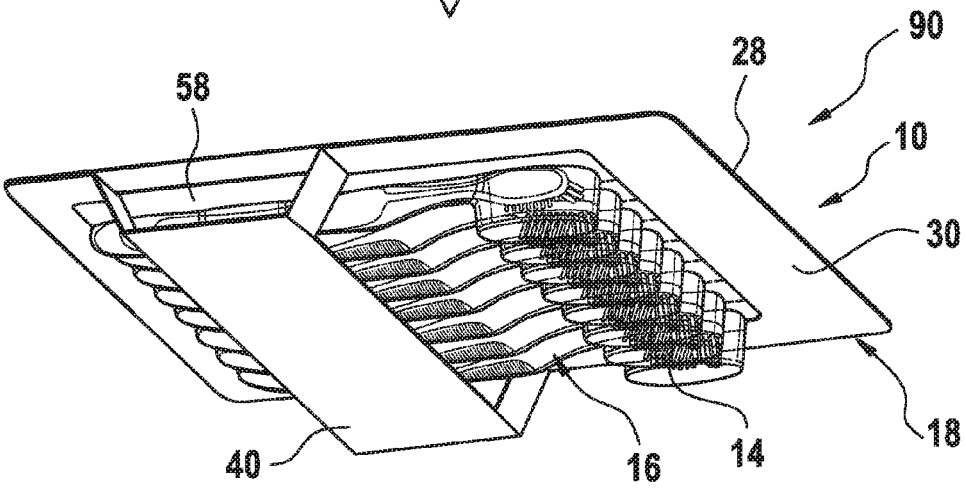

In the embodiment as shown in FIG. 5, the secondary package 18 further comprises a flap 50 hingeably connected to a lateral edge 52 of the first outer circumferential portion 36 of the front panel 30. The flap 50 provides space for printing artwork and/or information. The hingeable connection allows the flap 50 to be turned upwards in an open position or downwards onto, i.e. in alignment with the front panel 30. In case artwork and/or information is printed onto the inner surface 54 of the flap 50 facing the upper surface 56 of the front panel 30, information can be hidden from immediate visual inspection at the point of sale, for example, by flapping the flap 50 onto the front panel 30. Before a product 14 is taken out of the package kit 10, the consumer may turn the flap 50 in an open/upward position to read the respective information. The flap 50 and the front panel 30 are unitarily formed from one cardboard blank.

Process steps for manufacturing a package-product arrangement 10 according to FIGS. 1 to 4 are shown in FIGS. 6A-6D. In order to provide a primary package 16 comprising a plurality of products 14, the following manufacturing steps may be performed (not shown): A plastic sheet is provided which is inserted into a mold which has a plurality of mold cavities. The shape of the mold cavities correspond to the shape of the blister cavities to be formed. The plastic sheet is heated to a forming temperature so that the plastic sheet is pliable. Thereby, a plurality of cavities 20 is thermoformed into the plastic sheet to provide a blister layer 22 comprising a plurality of blister cavities 20. A plurality of products 14 is provided which are inserted into the respective blister cavities 20. A cardboard blank 24 is provided which is then attached to the blister layer 22, thereby providing a primary package 16 comprising a plurality of products 14.

In step 60, a back panel 28 and a front panel 30 are provided in a substantially flat manner. The front panel 30 comprises at least a first aperture 32 and a second aperture 34, at least a first outer circumferential portion 36 at least partially surrounding the first aperture 32, and a second outer circumferential portion 38 at least partially surrounding the second aperture 34, and a portion 40 being arranged between the first and the second apertures 32, 34 and extending from the first and the second outer circumferential portions 36, 38.

In step 70, the front panel 30 is folded in a manner that the portion 40 being arranged between the first aperture 32 and the second aperture 34 is elevated with respect to the first and the second outer circumferential portions 36, 38. Thereby, an inner recess 58 is formed.

In step 80, the primary package 16 is laid onto the back surface 62 of the front panel 30 so that the blister cavities 20 are placed in the recess 58 and extend through the first and second apertures 32, 34.

In step 90, the back panel 28 is attached to at least a portion of the first and the second outer circumferential portions 36, 38, thereby providing a secondary package 18 comprising the primary package 16 and the products 14.

The package-product arrangement 10 may have a length extension 64 of from about 200 mm to about 350 mm, optionally of from about 250 mm to about 320 mm, further optionally of about 302 mm, a width extension 66 of from about 200 mm to about 350 mm, optionally of from about 250 mm to about 300 mm, further optionally of about 275 mm, and a height extension 68 of from about 10 mm to about 40 mm, optionally of from about 20 mm to about 30 mm, further optionally of about 27 mm (FIGS. 1 and 2).

In the present context, the term "substantially" refers to an arrangement of elements or features that, while in theory would be expected to exhibit exact correspondence or behavior, may, in practice embody something slightly less than exact. As such, the term denotes the degree by which a quantitative value, measurement or other related representation may vary from a stated reference without resulting in a change in the basic function of the subject matter at issue.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

What is claimed is:

1. A package kit for storing a plurality of products, the package kit comprising:

a primary package, and a secondary package, the primary package comprising a plurality of individually sealed cavities for individually storing a product, the individually sealed cavities being separately detachable from the primary package, the secondary package comprising a back panel and a front panel, the primary package being sandwiched between the back panel and the front panel, the front panel comprising at least a first aperture and a second aperture for displaying at least a portion of the primary package, at least a first outer circumferential portion at least partially surrounding the first aperture and being attached at least partially to the back panel, and a second outer circumferential portion at least partially surrounding the second aperture and being attached at least partially to the back panel, wherein the front panel further comprises an elevated portion being arranged between the first aperture and the second aperture, and extending from the first and the second outer circumferential portions.

2. A package kit according to claim 1, wherein the first outer circumferential portion comprises a first limb and a second limb, and the second outer circumferential portion comprises a third limb and a fourth limb, and the elevated portion extends from the first limb, the second limb, the third limb, and the fourth limb, respectively.

3. A package kit according to claim 2, wherein the first limb and the second limb are hingeably connected with the first outer circumferential portion, and the third limb and the fourth limb are hingeably connected with the second outer circumferential portion.

4. A package kit according to claim 2, wherein the elevated portion is hingeably connected to the first, the second, the third and the fourth limb, respectively.

5. A package kit according to claim 1, wherein at least one of the front panel and the back panel is unitarily formed from a cardboard blank.

6. A package kit according to claim 1, wherein the front panel and the back panel are unitarily formed from one cardboard blank.

7. A package kit according to claim 1, wherein the front panel and the back panel are formed from two separate cardboard blanks, and the weight of the cardboard blank of the front panel is different from the weight of the cardboard blank of the back panel.

8. A package kit according to any of the preceding claims, wherein the secondary package comprises a flap hingeably connected to at least one of a lateral edge of the first outer circumferential portion of the front panel, a lateral edge of the second outer circumferential portion of the front panel, or hingeably connected to a lateral edge of the back panel.

9. A package kit according to claim 1, wherein the primary package is a blister package.

10. A package kit according to claim 9, wherein the blister package comprises a cardboard blank onto which a blister layer is attached, the blister layer comprising a plurality of blister cavities for storing the products, respectively.

11. A package kit according to claim 10, wherein the primary package comprises a plurality of perforation lines being provided between two neighboring blister cavities for detaching one or more individually sealed cavities from the primary package.

12. A package-product arrangement comprising a package kit according to claim 11 and a plurality of products.

13. A package-product arrangement according to claim 12, wherein at least one of the products is an oral care implement.

14. Process for the manufacture of a package-product arrangement according to claim 12, comprising the following steps:

providing a plastic sheet;

inserting the plastic sheet into a mold having a plurality of mold cavities;

heating the plastic sheet to a forming temperature in order to be pliable;

thermoforming a plurality of cavities into the plastic sheet, the cavities corresponding to the shape of the mold cavities, thereby providing a blister layer comprising a plurality of blister cavities;

providing a plurality of products;

inserting the products into respective blister cavities;

providing a cardboard blank;

attaching the cardboard blank onto the blister layer, thereby providing a primary package comprising a plurality of products;

providing a front panel in a substantially flat manner, the front panel comprising at least a first aperture and a second aperture, at least a first outer circumferential portion at least partially surrounding the first aperture, and a second outer circumferential portion at least partially surrounding the second aperture, and a portion being arranged between the first and the second aperture and extending from the first and the second outer circumferential portions;

folding the front panel in a manner that the portion being arranged between the first aperture and the second aperture is elevated with respect to the first and second outer circumferential portions and forms an inner recess;

laying the primary package onto the front panel so that the blister cavities are placed in the recess, and extend at least partially through the first aperture and the second aperture;

providing a back panel; and attaching the back panel to at least a portion of the first outer circumferential portion and to at least a portion of the second outer circumferential portion, thereby providing a secondary package comprising the primary package and the products.

15. A package-product arrangement obtainable by the process of claim 14.

* * * * *